US009286786B2

(12) United States Patent
Pham et al.

(10) Patent No.: US 9,286,786 B2
(45) Date of Patent: Mar. 15, 2016

(54) SURVEILLANCE SYSTEMS AND METHODS

(71) Applicant: Honeywell International Inc., Morristown, NJ (US)

(72) Inventors: Hai D. Pham, Eden Prairie, MN (US); Soumitri N. Kolavennu, Blaine, MN (US); Amit Kulkarni, Plymouth, MN (US); Aravind Padmanabhan, Plymouth, MN (US); Cleopatra Cabuz, Eden Prairie, MN (US); David J. Wunderlin, New Hope, MN (US)

(73) Assignee: Honeywell International Inc., Morristown, NJ (US)

( * ) Notice: Subject to any disclaimer, the term of this patent is extended or adjusted under 35 U.S.C. 154(b) by 110 days.

(21) Appl. No.: 13/944,181

(22) Filed: Jul. 17, 2013

(65) Prior Publication Data

US 2015/0022355 A1 Jan. 22, 2015

(51) Int. Cl.

| | |
|---|---|
| ***G08B 13/00*** | (2006.01) |
| ***G08B 25/10*** | (2006.01) |
| ***G08B 17/06*** | (2006.01) |

(52) U.S. Cl.

CPC ..... *G08B 25/10* (2013.01); *G08B 13/00* (2013.01); *G08B 17/06* (2013.01)

(58) Field of Classification Search

CPC ..... G08B 13/19658; G08B 13/19691; G08B 13/00; G08B 25/14; G08B 25/10; G08B 17/06; H04L 12/2827; H04M 11/64; H04N 7/18

USPC ..... 340/541, 540, 539.11, 539.18, 506, 340/545.1, 12.23; 348/143, 154, 156

See application file for complete search history.

(56) References Cited

U.S. PATENT DOCUMENTS

| | | | | |
|---|---|---|---|---|
| 7,786,891 | B2 * | 8/2010 | Owens et al. | 340/541 |
| 2004/0086089 | A1 * | 5/2004 | Naidoo et al. | 379/37 |
| 2007/0085676 | A1 * | 4/2007 | Lee et al. | 340/539.18 |
| 2012/0092167 | A1 * | 4/2012 | Hohl | 340/573.1 |
| 2013/0063265 | A1 * | 3/2013 | Feldstein et al. | 340/541 |

* cited by examiner

*Primary Examiner* — Anh V La

(74) *Attorney, Agent, or Firm* — Brooks, Cameron & Huebsch, PLLC

(57) ABSTRACT

Surveillance systems and methods are described herein. Surveillance systems and methods can include detecting a number of interactions within a building, determining an event based on the number of interactions, and sending a message to a number of contacts relating to the event.

20 Claims, 3 Drawing Sheets

SURVEILLANCE SYSTEMS AND METHODS

TECHNICAL FIELD

The present disclosure relates to surveillance systems and methods.

BACKGROUND

A thermostat can be utilized to detect and alter environmental features (e.g., temperature, etc.) within a building. The thermostat can use various sensors to detect current environmental features of the building and can alter the environmental features by sending instructions to environmental controllers (e.g., heating, ventilation, and air conditioning units (HVAC units), etc.). The thermostat can receive instructions to change environmental settings based on user preferences. For example, the thermostat can receive instructions on how to respond to particular environmental features.

DETAILED DESCRIPTION

Figure 1:
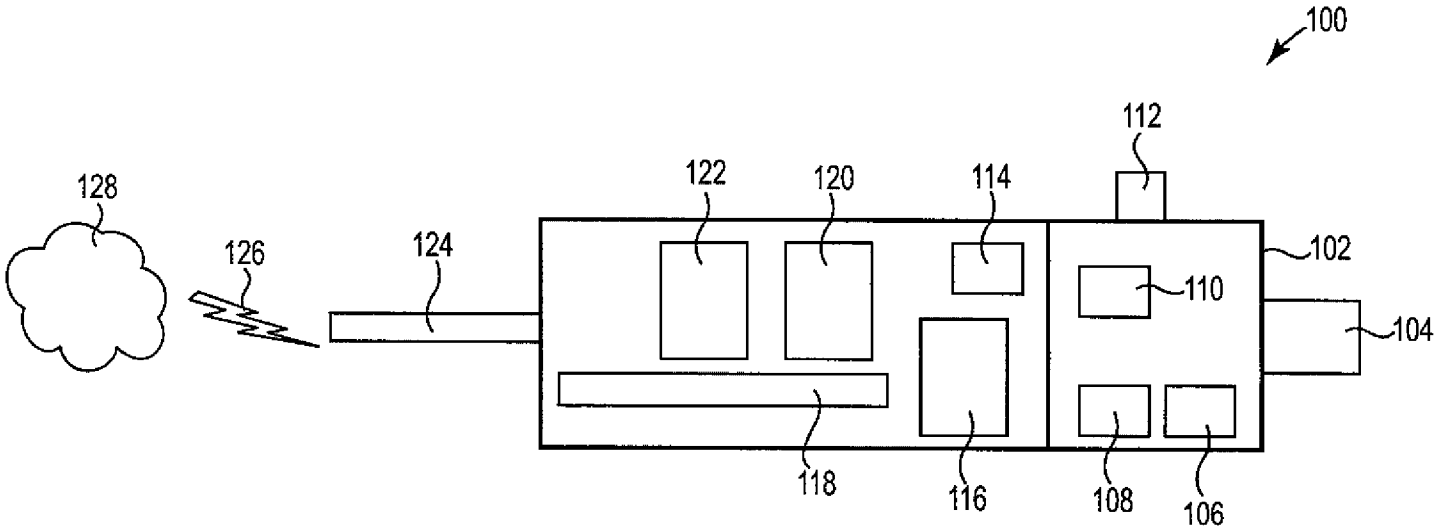
FIG. 1 illustrates an example of surveillance system in accordance with one or more embodiments of the present disclosure.

A surveillance method can include detecting a number of interactions within a building, determining an event based on the number of interactions, and sending a message to a number of contacts relating to the event.

Surveillance systems and methods can include utilizing a number of devices (e.g., thermostat, electronic hub, sensors, etc.) to detect a number of interactions within a building (e.g., residence, prison, nursing home, etc.) and/or environmental features of the building. The surveillance system can be included within a thermostat and/or an electronic hub (e.g., thermostat hub receiving a number of interactions via sensors in different areas of a building, etc.). The number of devices can utilize the number of interactions with the building and the environmental features of the building to determine if there is an event (e.g., building is too hot or cold, specific people are in the building, vocal instructions of an event, etc.) occurring.

If the surveillance system determines that there is an event (e.g., emergency event, etc.), the surveillance system can contact a number of contacts based on the event. For example, if it is determined that there is an event (e.g., fire, break in, etc.) occurring a number of contacts (e.g., police, fire department, hospital, etc.) can be contacted and informed of details relating to the event (e.g., type of event, address of the event, etc.). The advantages of having the surveillance system included within a thermostat and/or electronic hub can include providing continuous contact with the number of contacts even if people within the building are unable to directly contact the number of contacts during a particular event. In addition, if the number of contacts are contacted by the surveillance system, a communication link can be started between the number of contacts and the surveillance system that can continue until the communication link is no longer needed (e.g., emergency personnel have arrived, confirmation that an event is not occurring, etc.).

The surveillance system can include a number of devices than can be used to monitor actions in a plurality of areas within the building. The device can receive data from a plurality of sensors that can be located at a plurality of locations within the building. For example, each of a plurality of sensors can be included within a plurality of devices in each room of the building. The plurality of devices can each collect data and provide the data to a centralized hub and/or central thermostat. The plurality of devices can be utilized to collect data from an entire building.

The surveillance system can be used to record audio notes that can be played by a number of users. In addition, the surveillance system can be utilized as an intercom system to communicate between the plurality of devices via a network. The intercom system can enable a number of users to communicate to a number of other users utilizing the plurality of devices.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

As used herein, "a" or "a number of" something can refer to one or more such things. For example, "a number of devices" can refer to one or more devices.

FIG. 1 illustrates an example of surveillance system 100 in accordance with one or more embodiments of the present disclosure. The surveillance system 100 can include a number of devices (e.g., device 102, etc.). The number of devices can be similar and/or the same as device 102. In addition, there can be a plurality of devices each communicatively coupled to network 128 (e.g., WI-FI, Internet, Cloud, etc.). One of the plurality of devices can be designated as an electronic hub (e.g., central device to receive and analyze information, single device to change settings of the plurality of devices, etc.). The electronic hub can be a thermostat that can receive sensor information from a plurality of devices that are located at a plurality of locations within a building.

The device 102 can be a computing device (e.g., computing device 340, etc.). The device 102 can be a thermostat (e.g., communicatively coupled to an heating ventilation and cooling (HVAC) system, etc.) capable of instructing the HVAC system to control a temperature of the building. The device 102 can include an antenna 124 to communicate with a number of other devices (e.g., devices similar to device 102, etc.) via the network 128. That is, the antenna 124 can enable the device 102 to send messages to other devices (e.g., other computing devices, a hub, a thermostat, etc.) In addition, the antenna 124 can enable the device 102 to receive messages from other devices (e.g., a hub, a thermostat, a server, etc.). The sent and/or received messages can include, but are not limited to: firmware updates, received data, determined data from sensors (e.g., audio sensors, video sensors, proximity sensors, and motion sensors, etc.) and/or notifications of received data.

The antenna 124 can be specific to the type of network 128 being utilized. For example, the network 128 can be a WI-FI network within a particular building and the antenna 124 can be a WI-FI antenna (e.g., antenna capable of communicating with a WI-FI network, etc.). In addition, the device 102 can include a WI-FI/Wireless module 118 for communication utilizing the network 128.

The device 102 can include a microphone 112. The microphone 112 can be utilized to receive audio from within a particular area (e.g., room within the building, etc.). The audio can include voice commands to instruct the device 102 to perform a number of functions. For example, the voice command can include a person speaking instructions to the device 102 that there is an event (e.g., fire, etc.). The microphone 112 can be utilized to record voice messages that can be stored within the memory 110. For example, a first user can record a voice message utilizing the microphone 112. An indication can be displayed on the device 102 to notify a second user that there is a voice message. The second user can select the voice message and play the voice message utilizing a speaker 104. The received audio can be sent to a local voice engine 122 and/or an electronic hub to analyze the received audio. Alternatively or in addition, the received audio can be sent to a remote voice engine to analyze the received audio.

The device 102 can utilize the microphone 112 to enable an intercom system between a plurality of devices. The plurality of devices can have similar and/or the same functions as device 102. For example, the plurality of devices can each include a microphone and a speaker that can enable a number of users to communicate via audio communication utilizing the plurality of devices. The intercom system can enable communication for a plurality of areas within the building by utilizing the a microphone and/or a speaker.

The device 102 can include a voice engine 122 and/or a number of links to remote cloud voice engines. The voice engine 122 can be utilized to receive and analyze the audio received by the microphone 112. The voice engine 122 can be utilized to convert the received audio to text data or vice versa and/or to determine if there is a desired action corresponding to the received audio. For example, the voice engine 122 can be utilized to determine if the received audio corresponds to an event (e.g., emergency event, audio recording, etc.).

The voice engine 122 can enable a user to change a number of settings for the device 102. For example, a user can speak an instruction to the device 102 and the voice engine 122 can convert the audio message to text message or vice versa and utilize the text message or an audio signature to change a number of settings on the device 102.

The device 102 can include a speaker 104. The device 102 can utilize the speaker 104 to give messages to a number of users. The device 102 can utilize the speaker 104 to alert a user within the building that an event has been determined. For example, the device 102 can utilize the speaker 104 to alert the user that an event is occurring. It can be advantageous to alert a user that an event has been determined. For example, alerting the user that an event is occurring can give the user time to prevent the device 102 from contacting a number of contacts and/or activating a security system. The device 102 can also utilize the speaker 104 to play recorded audio that was previously recorded. In addition, the speaker 104 can issue voice commands to control a number of other voice activation devices within a particular area (e.g., area where the voice commands can be received, etc.) of the speaker 104.

The device 102 can also utilize the speaker 104 when contacting the number of contacts. A contact can be contacted by initializing an audio conversation, where the device 102 utilizes the speaker 104 and the microphone 112 to enable communication between a user in the building and one of the number of contacts. For example, the device 102 can initialize communication with a service (e.g., police dispatch, emergency service, etc.) based on the determined event and the device 102 can continue the communication with the service until the event has been neutralized (e.g., event no longer exists, event is confirmed to not exist, etc.).

The device 102 can include a surveillance functions enabler 120. The device 102 can utilize the surveillance functions enabler 120 by enabling communication between the device 102 and a security system for monitoring the activities of an interested zone (e.g., area of a building a user determines to monitor, etc.). For example, the device 102 and the security system can be communicatively coupled via a network 128. That is, the security system can be activated and/or deactivated by users locally and/or via a cloud computing system (e.g., private cloud, public cloud, network 128, etc.).

The device 102 can utilize the surveillance functions enabler 120 to enable a security system (e.g., alarm, security device, etc.) in response to a determined event. For example, the device 102 can determine that there is an event and the device can enable a function of the security system based on an event type (e.g., interested activity, fire, robbery, temperature, etc.). The device 102 can enable functions of the security system that correspond to the determined event. For example, if it is determined that an unauthorized person (e.g., intruder, stranger, etc.) is within the building (e.g., voice biometrics, etc.) the device 102 can enable the security system to signal an alarm or other function corresponding to the event (e.g., alerting home owner, alerting monitoring agent, alerting police, etc.).

The device 102 can include a thermostat sensor 114 (e.g., thermostat sensor cluster, etc.). The device 102 can utilize the thermostat sensor 114 to perform functions of a thermostat within the building. The functions of a thermostat can include determining a number of environmental features (e.g., temperature, carbon monoxide, humidity, oxygen levels, etc.) of the building. The thermostat sensor 114 can include a number of environmental settings to alter the number of environmental features. For example, the device 102 can utilize the thermostat sensor 114 to determine a temperature within an area of a building. In addition, the device 102 can utilize the thermostat sensor 114 to activate or deactivate a heating or cooling system (e.g., HVAC system, etc.) within the building based on the determined environmental features.

The device 102 can utilize the thermostat sensor 114 to determine an event that relates to an environmental feature (e.g., temperature, etc.) within the building. An event that relates to a temperature can include when a building exceeds a determined environmental feature (e.g., carbon monoxide, humidity, temperature, etc.) threshold. For example, an event can be determined when the temperature within the building and/or area exceeds a particular temperature (e.g., 75° F., 80° F. 100° F., carbon monoxide parts per million (ppm), 95 percent RH, etc.). In this example, an occupant and/or user within the building can be sensitive to high temperatures and if the temperature within the building exceeds a threshold temperature a contact can be contacted.

A contact can be contacted by the device 102 sending a message that includes a current environmental feature within the building. Additional information relating to the event can be included within the message sent to the contact. For example, additional information can include: the information relating to the time the temperature was recorded, when a user last changed a number of thermostat settings, and/or if there were interactions with the device 102. The message can give a contact that receives the message the settings (e.g., temperature settings, etc.), current conditions (e.g., current temperature, time conditions were detected, etc.), and/or user interactions within the building (e.g., determinations of people within an area, motion sensed, etc.).

The contact can also be contacted by the device 102 calling a mobile device to initiate a voice conversation with the contact. As described herein, the device 102 can initiate a voice conversation with a contact. Initiating the voice conversation can enable a user to confirm the current temperature with the user and/or confirm whether a particular user is within the building. As described herein, whether a particular user is within the building can be confirmed utilizing a number of features of the device 102. For example, the user can be confirmed to be in the building utilizing one or more of: the motion detector 108, the camera 106, the surveillance function enabler 120, the voice engine 122, among other features.

The device 102 can include a motion detector 108. The device 102 can utilize the motion detector 108 to collect movement information for an area within a building. The movement information can be utilized to determine if there are occupants (e.g., people, users, pets, etc.) within the building. For example, the motion detector 108 can detect movement within a particular area and if there is movement detected within the area it can be determined that an occupant is present. If it is determined that an occupant is within the area the occupant can be identified. For example, the occupant can be identified as an acceptable user (e.g., resident of the building, acceptable occupant, etc.).

The device 102 can utilize the motion detector 108 to determine a number of different events. For example, the device 102 can utilize the motion detector 108 to determine if an unwanted occupant is within the building. The motion detector 108 can also be utilized to determine if an occupant is still within the building. For example, if it is determined that the temperature of the building is beyond a determined threshold, the motion detector 108 can be utilized to determine if there is an occupant within the building. The information relating to the occupancy of the building can be sent to a number of contacts. For example, information relating to a quantity of time between detected motion within the building can be sent to the contacts. In another example, the determination of occupancy can be sent to the number of contacts.

The device 102 can include a camera 106. The camera 106 can be a video camera and/or photographic camera that can be utilized to capture images within the building. The camera 106 can be a fixed position camera that can view a single direction within an area. The camera 106 can also be a tilt position camera that can view multiple directions within a particular area. The images captured within the building can be utilized to determine a number of features and/or interactions within the building. For example, the camera 106 can be utilized to determine a number of occupants within the building.

If it is determined that there are a number of occupants within the building the camera 106 can be utilized to capture images of the occupants. For example, a number of images can be captured to identify an occupant during a determined event. For example, if an occupant utilizes the microphone to execute a command that an event is occurring, the camera 106 can be utilized to capture images of the occupant and/or utilized to determine an identity of the occupant. In this example, the identity can be determined utilizing a number of facial and/or surrounding scenery recognition capabilities. Information relating to the number of captured images can be sent to the number of contacts. For example, the number of captured images can be sent to a number of contacts. In another example, an identity of occupants captured within the images can be sent to the number of contacts.

Figure 3:
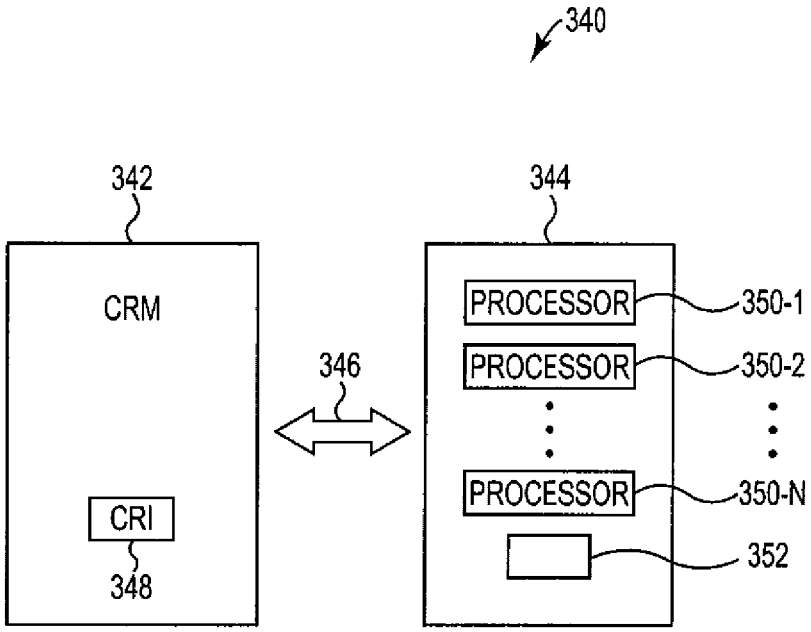
FIG. 3 illustrates a block diagram of an example of a computing device in accordance with one or more embodiments of the present disclosure.

The device 102 can include memory 110 (e.g., computer readable memory 342 as referenced in FIG. 3, etc.). The memory 110 can be utilized to store instructions (e.g., computer readable instructions, etc.) that can be executed by a processor to perform a number of functions as described herein. In addition, the memory 110 can be utilized to store a number of user preferences and/or thresholds for determining if an event has occurred. As described herein, the memory 110 can be utilized to store voice messages. The voice messages can be received utilizing the microphone 112 and can be played utilizing the speaker 104. The voice messages can be received at a first device, stored in memory 110, and then played at a second device at a different location than the first device.

The system 100 can include a plurality of devices that includes device 102. Each of the plurality of devices can be coupled to network 128 via a communication path 126. The plurality of devices can work together in order to gather data for an entire building by placing a number of devices within each area of the building. Data can be collected from all areas by placing a number of devices within each area of the building and utilizing the plurality of sensors within each device to collect data from a corresponding area. In this way surveillance of an entire building can be provided with information being sent to a number of contacts. The system 100 can be utilized to provide surveillance functions, intercom functions, and/or messaging functions.

Figure 2:
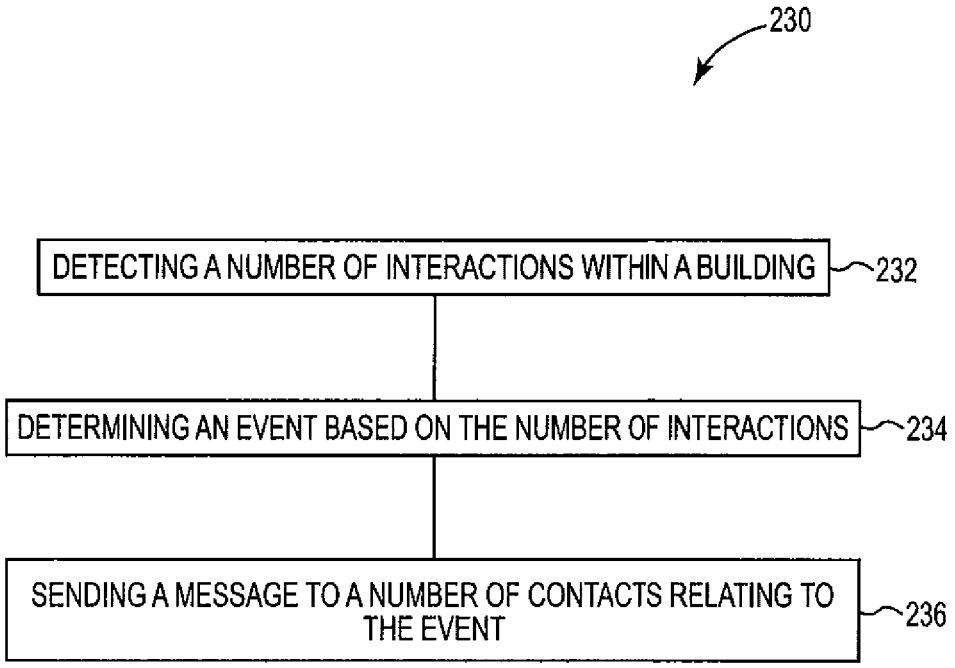
FIG. 2 illustrates an example method for surveillance in accordance with one or more embodiments of the present disclosure.

FIG. 2 illustrates an example method 230 for surveillance in accordance with one or more embodiments of the present disclosure. The method 230 can be utilized to detect an event and send a message that alerts a number of contacts that the event has been detected. The number of contacts can be emergency contacts, caretaker contacts, family contacts, among other contacts that might request information relating to the events.

At box 232 the method 230 can include detecting a number of interactions within a building. Detecting the number of interactions can include utilizing a plurality of sensors (e.g., motion sensors, cameras, microphones, temperature sensors, thermostats, etc.) to retrieve the interactions within the building. For example, detecting the number of interactions can include detecting a number of movements within a building utilizing motion sensors and cameras. In another example, detecting the number of interactions can include detecting audio from a user and determining an event based on the audio. Furthermore, detecting the number of interactions can include detecting the temperature within the building.

As described herein, a device (e.g., device 102 as referenced in FIG. 1, thermostat, etc.) can be utilized to in detecting the number of interactions within the building. The interactions can include human interactions within the building not relating to the device (e.g., walking, watching television, etc.). The interactions can also include human interactions within the building that do relate to the device (e.g., changing settings on the device, recording a message with the device, requesting help from the device, informing the device of that an event is occurring, etc.).

As described herein, a plurality of devices can be coupled via a network (e.g., network 128 as referenced in FIG. 1, etc.). The data collected from the plurality of devices can be utilized to detect the number of interactions in a plurality of different areas within a building.

At box 234 the method 230 can include determining an event (e.g., temperature, carbon monoxide, humidity exceeding levels, personal injury, fire, break-in, etc.) based on the number of interactions. Determining the event can include determining that conditions within the building are less than safe compared to different conditions. For example, the event can include the building having temperatures that exceed a threshold. In this example, temperatures that exceed the threshold can be dangerous to occupants of the building.

Determining the event can include receiving an instruction from a user that an event is occurring. The instruction can be a vocal instruction from within the building. The instruction can also be an instruction from a mobile device. The mobile device can deliver the instruction from a location that is different from the location of the building.

At box 236 the method 230 can include sending a message to a number of contacts relating to the event. Sending the message to the number of contacts can include sending a message of text data with information relating to the event. Sending the message to the number of contacts can also include initiating an audio conversation with the number of contacts. That is, the message can be a telephone call to a mobile device and/or land line.

The number of contacts can be determined based on a type of event that is determined. For example, if the type of event is that the air conditioning unit is not functioning properly and the temperature of the building is above a threshold, it can be determined that a care taker contact can be contacted. In addition, a repair person contact can also be contacted to ensure that the air conditioning unit is promptly repaired.

As described herein, the message can be a text message that can include information relating to the event. For example, the message can include data relating to the number of interactions. For example, the data relating to the number of interactions can include: a time the interaction was detected, number of detected occupants, identity of occupants, audio commands, setting changes, among other data relating to the number of interactions.

The method 230 can include a plurality of devices within a plurality of areas within the building. As described herein, a device hub (e.g., thermostat, central device, etc.) can be utilized to receive data from each of the plurality of devices. The device hub can be a computing device and/or thermostat that can determine if an event is occurring within an area of the building. In addition, the device hub can include the number of sensors as described herein. The plurality of devices can be utilized to provide surveillance functions, intercom functions, and/or messaging functions.

FIG. 3 illustrates a block diagram of an example of a computing device 340 in accordance with one or more embodiments of the present disclosure. The computing device 340 can include a communication interface (e.g., wireless network interface controller, adapters, etc.) for receiving (e.g., transceiving, etc.) wireless data. The communication interface can be integrated in the computing device 340 and/or be an external card. The computing device 340, as described herein, can also include a computer readable medium (CRM) 342 in communication with processing resources 350-1, 350-2, . . . , 350-N. CRM 342 can be in communication with a device 344 (e.g., a thermostat with voice, an application server, among others) having processor resources 350-1, 350-2, . . . , 350-N. The device 344 can be in communication with a tangible non-transitory CRM 342 storing a set of computer-readable instructions (CRI) 348 (e.g., modules) executable by one or more of the processor resources 350-1, 350-2, . . . , 350-N, as described herein. The CRI 348 can also be stored in remote memory managed by a server and represent an installation package that can be downloaded, installed, and executed. The device 344 can include memory resources 352, and the processor resources 350-1, 350-2, . . . , 350-N can be coupled to the memory resources 352.

Processor resources 350-1, 350-2, . . . , 350-N can execute CRI 348 that can be stored on an internal or external non-transitory CRM 342.

The processor resources 350-1, 350-2, . . . , 350-N can execute CRI 348 to perform various functions. For example, the processor resources 350-1, 350-2, . . . , 350-N can execute CRI 348 to perform a number of functions (e.g., determining an event based on the number of interactions, sending a message to a number of contacts relating to the event, etc.). A non-transitory CRM (e.g., CRM 342), as used herein, can include volatile and/or non-volatile memory. Volatile memory can include memory that depends upon power to store information, such as various types of dynamic random access memory (DRAM), among others. Non-volatile memory can include memory that does not depend upon power to store information. Examples of non-volatile memory can include solid state media such as flash memory, electrically erasable programmable read-only memory (EEPROM), phase change random access memory (PCRAM), magnetic memory such as a hard disk, tape drives, floppy disk, and/or tape memory, optical discs, digital versatile discs (DVD), Blu-ray discs (BD), compact discs (CD), and/or a solid state drive (SSD), as well as other types of computer-readable media. The non-transitory CRM 342 can also include distributed storage media. For example, the CRM 342 can be distributed among various locations.

The non-transitory CRM 342 can be integral, or communicatively coupled, to a computing device, in a wired and/or a wireless manner. For example, the non-transitory CRM 342 can be an internal memory, a portable memory, a portable disk, or a memory associated with another computing resource (e.g., enabling CRIs to be transferred and/or executed across a network such as the Internet).

The CRM 342 can be in communication with the processor resources 350-1, 350-2, . . . , 350-N via a communication path 346. The communication path 346 can be local or remote to a machine (e.g., a computer) associated with the processor resources 350-1, 350-2, . . . , 350-N. Examples of a local communication path 346 can include an electrical bus internal to a machine (e.g., a computer) where the CRM 342 is one of volatile, non-volatile, fixed, and/or removable storage medium in communication with the processor resources 350-1, 350-2, . . . , 350-N via the electrical bus. Examples of such electrical buses can include Industry Standard Architecture (ISA), Peripheral Component Interconnect (PCI), Advanced Technology Attachment (ATA), Small Computer System Interface (SCSI), Universal Serial Bus (USB), among other types of electrical buses and variants thereof.

The communication path 346 can be such that the CRM 342 is remote from the processor resources e.g., 350-1, 350-2, 350-N, such as in a network relationship between the CRM 342 and the processor resources (e.g., 350-1, 350-2, . . . , 350-N). That is, the communication path 346 can be a network relationship. Examples of such a network relationship can include a local area network (LAN), wide area network (WAN), personal area network (PAN), and the Internet, among others. In such examples, the CRM 342 can be associated with a first computing device and the processor resources 350-1, 350-2, . . . , 350-N can be associated with a second computing device (e.g., a Java®server).

As described herein, a "module" can include computer readable instructions (e.g., CRI 348) that can be executed by a processor to perform a particular function. A module can also include hardware, firmware, and/or logic that can perform a particular function.

As used herein, "logic" is an alternative or additional processing resource to execute the actions and/or functions, described herein, which includes hardware (e.g., various forms of transistor logic, application specific integrated circuits (ASICs)), as opposed to computer executable instructions (e.g., software, firmware) stored in memory and executable by a processor.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for surveillance, comprising:

detecting a number of interactions within a building, wherein the number of interactions include environmental interactions and occupant interactions;

determining an event based on the number of environmental interactions and occupant interactions within the building, wherein the occupant interactions include actions of a user that are detected within the building;

determining an identity of a number of occupants within the building during the determined event; and sending a message to a number of designated contacts during the determined event when the environmental interactions of the determined event are a threat to the identified number of occupants within the building.

2. The method of claim 1, wherein detecting the number of interactions includes detecting number of human interactions within the building.

3. The method of claim 2, wherein the number of human interactions includes vocal interactions with a device hub.

4. The method of claim 2, wherein the number of human interactions includes a number of motions within the building.

5. The method of claim 1, wherein determining the event includes receiving a voice command.

6. The method of claim 1, wherein determining the event includes receiving a notification from a mobile device.

7. The method of claim 1, comprising storing a number of voice recordings.

8. A non-transitory computer readable medium, comprising instructions to:

receive a number of detected interactions within an area, wherein the number of interactions include environmental interactions and occupant interactions within the area, wherein the occupant interactions include actions of a user that are detected within the area;

determine a response based on the number of detected environmental interactions, occupant interactions, and an identity of a number of occupants within the area during the detected interactions within the area, wherein the response includes altering a number of environmental settings for the area;

determine a number of contacts based on the detected interactions and identity of the number of occupants within the area during the detected interactions within the area; and send a message to the number of contacts when the environmental interactions are a threat to the identified number of occupants within the area.

9. The medium of claim 8, wherein the number of detected interactions includes data provided by a voice activated device.

10. The medium of claim 8, wherein altering the number of environmental settings includes altering a room temperature setting.

11. The medium of claim 8, wherein the message includes information relating to the number of detected interactions.

12. The medium of claim 8, wherein the message includes initiating an audio conversation with the number of contacts.

13. The medium of claim 8, wherein the number of contacts includes an emergency contact.

14. The medium of claim 8, wherein the number of environmental settings includes altering security system settings.

15. A system, comprising:

a computing device hub including instructions to:

detect a number of interactions within a first area, wherein the number of interactions include environmental interactions within the first area;

receive a number of detected interactions from sensors within a second area, wherein the number of detected interactions include occupant interactions within the second area;

determine a response based on the number of detected interactions from the first and second areas, wherein the response includes altering a number of environmental settings based on an identity of a number of occupants corresponding to the occupant interactions;

determine a number of contacts based on the environmental interactions within the first area and the identity of the number of occupants corresponding to the occupant interactions within the second area; and send a message to the number of contacts when the environmental interactions within the first area are a threat to the identified number of occupants within the second area.

16. The system of claim 15, wherein detecting the interactions includes utilizing audio sensors, video sensors, proximity sensors, and motion sensors.

17. The system of claim 15, wherein the computing device hub is communicatively coupled to a security system.

18. The system of claim 17, wherein the response includes altering a number of settings of the security system.

19. The system of claim 17, wherein the number of contacts includes an emergency contact via the security system.

20. The system of claim 15, wherein the response is based on a number of people within the first and second areas.

* * * * *